US010897932B2

(12) United States Patent
Gibson et al.

(10) Patent No.: US 10,897,932 B2
(45) Date of Patent: Jan. 26, 2021

(54) STOCKINGFOOT WADER

(71) Applicant: Simms Fishing Products LLC, Bozeman, MT (US)

(72) Inventors: Robert Gibson, Bozeman, MT (US); Derek Gustafson, Bozeman, MT (US); Simon Quay, Portland, OR (US); Jeremy Grodkiewicz, Portland, OR (US)

( * ) Notice: Subject to any disclaimer, the term of this patent is extended or adjusted under 35 U.S.C. 154(b) by 0 days.

(21) Appl. No.: 16/016,633

(22) Filed: Jun. 24, 2018

(65) Prior Publication Data

US 2019/0387811 A1 Dec. 26, 2019

(51) Int. Cl.

| | |
|---|---|
| ***A41D 13/06*** | (2006.01) |
| ***A41B 11/02*** | (2006.01) |
| ***A41D 13/012*** | (2006.01) |

(52) U.S. Cl.

CPC ..... *A41B 11/02* (2013.01); *A41D 13/012* (2013.01); *A41D 13/06* (2013.01); *A41B 2400/34* (2013.01); *A41B 2400/60* (2013.01); *A41B 2500/52* (2013.01); *A41D 2400/42* (2013.01); *A41D 2500/10* (2013.01); *A41D 2600/106* (2013.01)

(58) Field of Classification Search

CPC .. A41D 13/012; A41D 13/00; A41D 13/0543; A41B 11/00; A41B 2400/34; A61F 2/7812; A63B 71/1225; A63B 2071/1275; A63B 2071/1258

USPC ..... 2/82, 22; 36/106

See application file for complete search history.

(56) References Cited

U.S. PATENT DOCUMENTS

| | | | | | |
|---|---|---|---|---|---|
| 757,424 | A | | 4/1904 | Vohl | |
| 3,003,154 | A | * | 10/1961 | Litman | A41B 11/02 2/239 |
| 3,092,110 | A | * | 6/1963 | Duensing | A61F 13/061 604/312 |
| 3,128,566 | A | | 4/1964 | Burlison et al. | |
| 4,912,860 | A | * | 4/1990 | Keller | A41D 13/012 2/227 |
| 5,295,312 | A | | 3/1994 | Blumberg et al. | |
| 5,319,807 | A | | 6/1994 | Brier | |
| 5,353,524 | A | | 10/1994 | Brier | |
| 5,421,034 | A | * | 6/1995 | Keune | A41B 11/00 2/22 |
| 5,499,459 | A | | 3/1996 | Tomaro | |
| 5,708,985 | A | | 6/1998 | Ogden | |
| 6,286,151 | B1 | | 11/2001 | Lambertz | |
| 7,392,601 | B2 | | 7/2008 | Vattes et al. | |
| 8,146,266 | B2 | | 3/2012 | Vattes et al. | |
| 8,191,284 | B2 | | 5/2012 | Cho | |

(Continued)

*Primary Examiner* — Jillian K Pierorazio

(74) *Attorney, Agent, or Firm* — Antoinette M. Tease

(57) ABSTRACT

A wader comprising a body portion and a bootie. The bootie is attached to the body portion. The bootie is comprised of a toe piece, an ankle piece, and a sole piece. The toe piece, the ankle piece, and the sole piece are adhered together to form the bootie. The toe piece has an outside surface, and the toe piece comprises a raised neoprene area on the outside surface. The ankle piece has an inside surface, and the ankle piece comprises a raised neoprene area on the inside surface. The toe piece, the ankle piece, and the sole piece are all comprised of a neoprene material. The raised neoprene area on the inside surface of the ankle piece is configured to wick moisture up and away from the foot of the wearer.

6 Claims, 9 Drawing Sheets

(56) References Cited

U.S. PATENT DOCUMENTS

| | | | | |
|---|---|---|---|---|
| 8,359,769 | B2 | 1/2013 | Vattes et al. | |
| 9,226,527 | B2 | 1/2016 | Dahlgren et al. | |
| 10,136,684 | B2 * | 11/2018 | Meiselman | A41D 19/0006 |
| 2006/0143801 | A1 | 7/2006 | Lambertz | |
| 2006/0277785 | A1 | 12/2006 | Vattes et al. | |
| 2006/0277786 | A1 | 12/2006 | Vattes et al. | |
| 2006/0277787 | A1 | 12/2006 | Vattes et al. | |
| 2011/0041365 | A1 * | 2/2011 | Ludemann | A43B 3/0057 36/3 R |
| 2011/0099855 | A1 | 5/2011 | Cho | |
| 2011/0307993 | A1 * | 12/2011 | McAfee | A41D 13/012 2/82 |
| 2014/0157491 | A1 | 6/2014 | Dahlgren | |
| 2015/0034511 | A1 * | 2/2015 | Hughes | A63B 71/1225 206/278 |
| 2015/0047103 | A1 * | 2/2015 | Dahlgren | A41B 11/02 2/239 |

* cited by examiner

STOCKINGFOOT WADER

BACKGROUND OF THE INVENTION

1. Field of the Invention

The present invention relates generally to the field of fishing waders, and more specifically, to a stockingfoot wader with raised neoprene patterns in the outside toe and inside ankle areas of the bootie to improve airflow, warmth, comfort and fit.

2. Description of the Related Art

Since at least the turn of the last century, inventors have been attempting to solve the problem of heat and moisture accumulation in footwear. Some of these inventions are described below. None of these inventions is specifically designed to be incorporated with a fishing wader, and none possesses the unique structural features of the present invention, as described more fully below.

U.S. Pat. No. 757,424 (Vohl, 1904) discloses a shoe with a lining of open texture having spacing ribs or cords to form air-channels. The lining is comprised of a textile fabric, and the cords or ribs are secured or fastened to the outside surface of the lining. The cords or ribs extend from the sole to the top of the lining and are sized and spaced a sufficient distance apart to keep the lining from coming into contact with the shoe when the shoe is upon a foot. The lining further comprises a stiff sole with a metal plate adhered to it.

U.S. Pat. No. 3,128,566 (Burleson et al., 1961) describes a ventilated boot with an air pump in the heel that is activated during walking. As pressure is placed on the heel portion of the boot, a hollow cavity in the heel portion is collapsed, thereby forcing air to be expelled from the cavity, to travel through various passageways within the boot, and to be expelled at various locations within the interior of the boot. As weight is lifted from the heel during normal ambulatory action, the resilient material of the insulation causes the cavity to return to a normal position and fresh air to be drawn into the cavity through inlet passageways. This cycle is repeated during each walking step.

U.S. Pat. No. 5,295,312 (Blumberg et al., 1994) provides a ventilated boot or shoe with a spongy open-celled compressible insole. The insole comprises two pairs of channels that are configured to allow air to enter the insole at the heel and instep areas. Ventilation pipes extend downwardly from the open top of the boot or shoe and are connected to the channels. As the wearer walks, the insole is compressed and expels air trapped in the open cells of the insole. As pressure on the insole eases, the resilient insole expands and draws air back into itself through the ventilation pipes.

U.S. Pat. No. 5,319,807 (Brier, 1994) and U.S. Pat. No. 5,353,524 (Brier, 1994) both disclose a moisture-management sock and shoe in which the sock has a multi-layer moisture-wicking channel that extends from the ankle to the toe area of the sock. The sock further comprises air circulation channels that extend along opposing sides of the moisture-wicking channel. The shoe has a moisture-wicking inner liner situated adjacent to the tongue and the toe box area for moving moisture from the foot and through the shoe. The shoe and sock are designed to be worn together.

U.S. Pat. No. 5,499,459 (Tomaro, 1996) describes an article of footwear with first and second replaceable booties that fit within the article of footwear. The first bootie comprises a waterproofing layer of material that is impervious to penetration by water. The second bootie comprises an inner layer fabricated of a moisture-absorbing and breathable material. The booties are interchangeable and have releasable attachment elements for releasably securing the booties within the footwear.

U.S. Pat. No. 5,708,985 (Ogden, 1998) provides a sock that is knitted with successes courses of yarn and that has a number of spaced ribs extending longitudinally between the heel and toe. The ribs are formed by knitting a selected number of additional courses of yarn extending from the outer layer of the sock toward the instep portion of the sock. The individual ribs are either continuous in the transverse direction, or they are discontinuous with transverse spaces formed along each rib in between sections of stitched yarn. The longitudinal spaces between the ribs and the transverse spaces within the individual ribs are of sufficient width to induce the skin of the plantar surface of the foot to extend at least partially therein, thereby enhancing the frictional engagement of the sock with the foot.

U.S. Pat. No. 6,286,151 (Lambert, 2001) discloses a sock that is designed to wick sweat out of a shoe. The sock has an integrated airway that extends from the sole to the top of the sock. The airway is comprised of heat-regulating netted fabric. U.S. Patent Application Pub. No. 2006/0143801 (Lambert) discloses a sock with a dehumidifying channel in the sole of the sock. Air ducts are provided on the inner leg side and/or the outer leg side of the sock and are connected to the dehumidifying channel.

U.S. Pat. No. 7,392,601 (Vattes et al., 2008) describes a foot covering with an elasticized chimney structure. The chimney structure is a plurality of chimneys that are configured to move heat or moisture from within the foot covering out through the collar region of the foot covering. Each chimney is comprised of a pair of elongated supports and a series of distributed braces that connect the elongated supports. The braces are movable from an at-rest position to a stretched position or a compressed position as the foot moves during wear.

U.S. Pat. No. 8,146,266 (Vattes et al., 2012) provides an article of footwear with a chimney structure comprised of a plurality of chimneys that define pathways for moving heat or moisture from within to outside the article of footwear. Each chimney has a pair of sidewalls, a rear wall situated between the sidewalls, and an open side opposite the rear wall. The open side of the chimney faces the cavity formed with the article of footwear for receiving a foot and is adjacent to the foot during wear. Specialized footbeds may be incorporated to evacuate hot, moist air away from the underside of the foot and toward the chimneys. U.S. Pat. No. 8,359,769 (Vattes et al., 2013) describes a number of alternate embodiments involving chimney structures in various configurations. The latter chimney structures are disposed along the tongue and/or upper areas of the article of footwear.

U.S. Pat. No. 8,191,284 (Cho, 2012) discloses a footwear cooling system in which the sole of an article of footwear has two compression chambers. As these chambers are compressed during the act of walking, a pressure imbalance is created between the two chambers, thereby causing air to be disposed along the upper sole portion via apertures in the upper sole portion. Channels situated between the compression chambers and the apertures facilitate the passage of air from the lower sole to the upper sole area.

U.S. Pat. No. 9,226,527 (Dahlgren et al., 2016) and U.S. Patent Application Pub. No. 2014/0157491 (Dahlgren) involve socks that are specifically designed to transfer moisture away from the foot. The socks comprise ribs, channels and padding that are positioned to facilitate moisture movement from the interior of the sock upwardly and outwardly from a shoe or boot. In one embodiment, the tubular portion of the sock has multiple tube ribs transversally positioned and longitudinally spaced apart to form tube channels. These ribs are formed with additional yarn material and are configured to contact the foot of the wearer. The invention utilizes a combination of hydrophobic and hydrophilic materials to further facilitate the movement of moisture.

BRIEF SUMMARY OF THE INVENTION

The present invention is a wader comprising a body portion and a bootie; wherein the bootie is attached to the body portion; wherein the bootie is comprised of a toe piece, an ankle piece, and a sole piece; wherein the toe piece, the ankle piece, and the sole piece are adhered together to form the bootie; wherein the toe piece has an outside surface, and the toe piece comprises a raised neoprene area on the outside surface; wherein the ankle piece has an inside surface, and the ankle piece comprises a raised neoprene area on the inside surface; and wherein the toe piece, the ankle piece, and the sole piece are all comprised of a neoprene material. In a preferred embodiment, the raised neoprene area on the inside of the ankle piece comprises an ankle segment that is situated proximate the ankle of a wearer when the bootie is worn; wherein the ankle segment comprises a top edge; wherein the raised neoprene area on the inside of the ankle piece further comprises a plurality of vertically oriented segments with bottom ends; wherein the vertically oriented segments are configured to form a fluid channel around a top area of the ankle segment between the bottom ends of at least some of the vertically oriented segments and the top edge of the ankle segment; and wherein the vertically oriented segments are configured to form vertically oriented fluid channels between the vertically oriented segments.

In a preferred embodiment, the bootie has an inside with a circumference formed by the ankle piece and the sole piece, and the vertically oriented segments extend circumferentially around an entire inside of the bootie except for that portion of the bootie that is formed by the sole piece. In a preferred embodiment, the vertically oriented segments are configured to form an arch over a midfoot of the wearer, and the bottom ends of the vertically oriented segments are configured to form an arch over an ankle bone of the wearer. The bootie comprises an inside surface, and an entire inside surface of the bootie is preferably coated with an antimicrobial chemical.

In one embodiment, the raised neoprene area on the outside of the toe piece is manufactured by compression molding a single layer of neoprene material, and the raised neoprene are on the inside of the ankle piece is manufactured by compression molding a single layer of neoprene material. Preferably, after compression of the toe piece, the raised neoprene area on the outside of the toe piece has a durometer of 11 and that portion of the single layer of neoprene material that is compressed has a durometer of 20 using a GS-701N type C durometer tester; and after compression of the ankle piece, the raised neoprene area on the inside of the ankle piece has a durometer of 11 and that portion of the single layer of neoprene material that is compressed has a durometer of 25 using a GS-701N type C durometer tester. Preferably, after compression of the toe piece, the raised neoprene area of the toe piece has a thickness of six millimeters and that portion of the single layer of neoprene material that is compressed has a thickness of four millimeters; and after compression of the ankle piece, the raised neoprene area of the ankle piece has a thickness of eight millimeters and that portion of the single layer of neoprene material that is compressed has a thickness of four millimeters.

In another embodiment, the raised neoprene area on the outside of the toe piece is manufactured by stacking a neoprene island in the form of the raised neoprene area on top of an underlying layer of neoprene material, adhering the neoprene island to the underlying layer of neoprene material, and adhering a layer of knit jersey material to a top surface of the neoprene island and the underlying layer of neoprene material, and the raised neoprene area on the inside of the ankle piece is manufactured by stacking a neoprene island in the form of the raised neoprene area on top of an underlying layer of neoprene material, adhering the neoprene island to the underlying layer of neoprene material, and adhering a layer of knit jersey material to a top surface of the neoprene island and a top surface of the underlying layer of neoprene material. Preferably, both the neoprene island and the underlying layer of neoprene material of the toe piece have a durometer of 11, both the neoprene island and the underlying layer of neoprene material of the ankle piece have a durometer of 11, and the sole piece has a durometer of 18 using a GS-701N type C durometer tester. Preferably, the neoprene island of the toe piece has a thickness of two millimeters and the underlying layer of neoprene material of the toe piece has a thickness of three millimeters; and the neoprene island of the ankle piece has a thickness of three millimeters and the underlying layer of neoprene material of the ankle piece has a thickness of three millimeters.

In a preferred embodiment, the raised neoprene area on the outside surface of the toe piece comprises a lateral portion that extends laterally across a front of the toe area, two extensions extending rearwardly from a center part of the lateral portion, and two wings that are parallel to and situated outside of each of the two rearwardly extending extensions; and the lateral portion, rearwardly extending extensions and wings are all interconnected.

BRIEF DESCRIPTION OF THE DRAWINGS

FIG. 9 is a section view of the toe piece of the bootie shown in relation to the press tool but before the tool comes into contact with the toe piece.

FIG. 10 is a section view of the toe piece of the bootie shown in relation to the press tool during the compression step.

FIG. 11 is a section view of the toe piece of the bootie shown with the press tool being removed after compression.

FIG. 12 is a section view of the ankle piece of the bootie shown in relation to the press tool but before the tool comes into contact with the ankle piece.

FIG. 13 is a section view of the ankle piece of the bootie shown in relation to the press tool during the compression step.

FIG. 14 is a section view of the ankle piece of the bootie shown with the press tool being removed after compression.

FIG. 15 is an exploded view of the toe piece of the bootie shown prior to assembly.

FIG. 16 is a section view of the flat heat press positioned above the neoprene island and the underlying neoprene layer.

FIG. 17 is a section view of the toe piece of the bootie shown with the flat heat press in contact with the neoprene layers but with the knit layer omitted.

FIG. 18 is a section view of the toe piece of the bootie shown with the press tool (in the form of a female mold) positioned above the neoprene island and the underlying neoprene layer with the knit jersey fabric situated between the press tool and the neoprene layers.

FIG. 19 is a section view of the toe piece of the bootie shown with the press tool in contact with the knit jersey layer.

FIG. 20 is a section view of the toe piece of the bootie shown with the press tool being removed after the final adhesive step.

FIG. 21 is an exploded view of the toe piece of the bootie shown prior to assembly.

FIG. 22 is a section view of the flat heat press positioned above the neoprene island and the underlying neoprene layer.

FIG. 23 is a section view of the toe piece of the bootie shown with the flat heat press in contact with the neoprene layers but with the knit layer omitted.

FIG. 24 is a section view of the toe piece of the bootie shown with the press tool (in the form of a female mold) positioned above the neoprene island and the underlying neoprene layer with the knit jersey fabric situated between the press tool and the neoprene layers.

FIG. 25 is a section view of the toe piece of the bootie shown with the press tool in contact with the knit jersey layer.

FIG. 26 is a section view of the toe piece of the bootie shown with the press tool being removed after the final adhesive step.

REFERENCE NUMBERS

Figure 1:
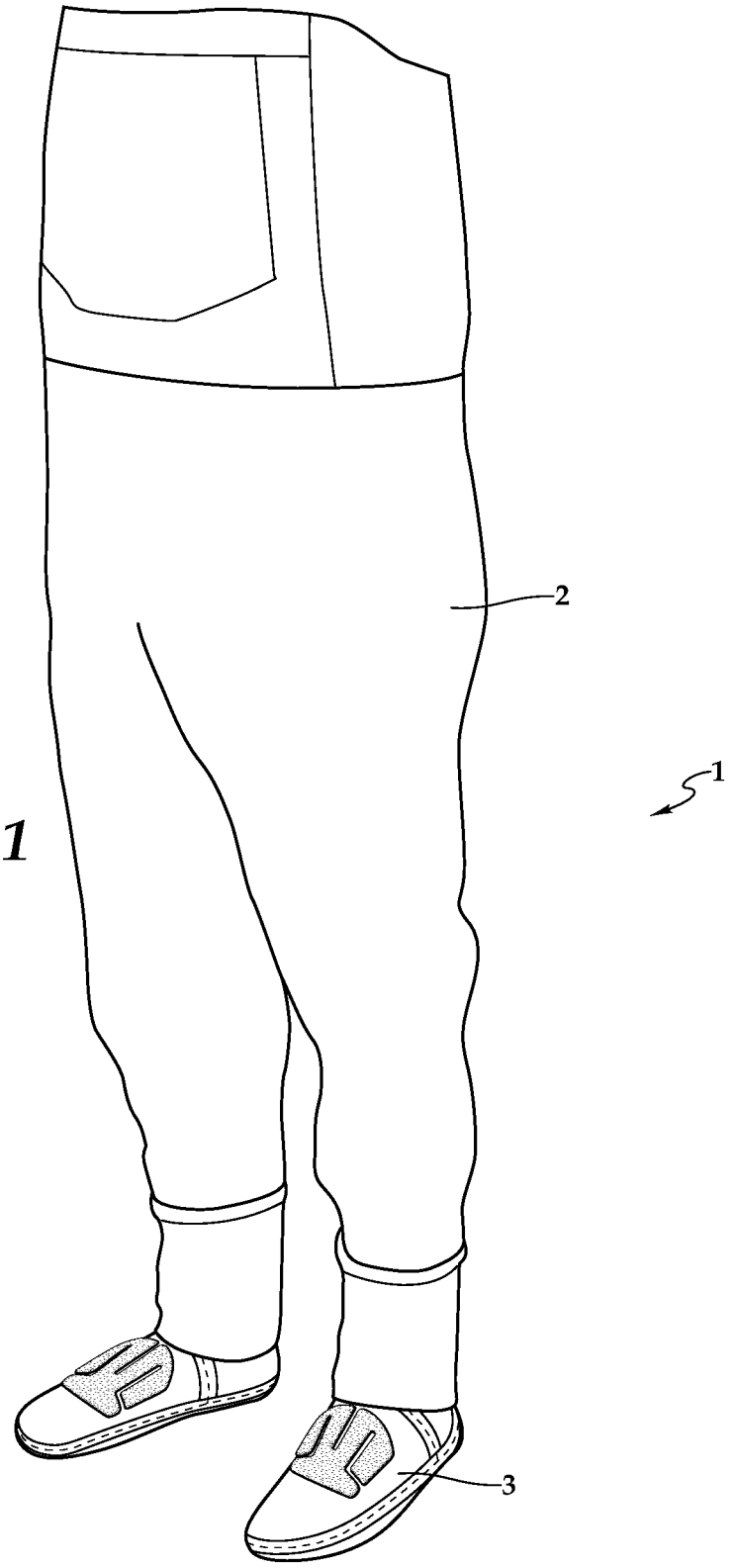
FIG. 1 is a perspective view of the present invention.

1 Wader
2 Body portion
3 Bootie
4 Toe piece
5 Ankle piece
6 Sole piece
7 Tape
8 Seam
9 Raised neoprene area (on outside of toe piece)
10 Raised neoprene area (on inside of ankle piece)
11 Ankle segment
12 Vertically oriented segment
13 Fluid channel (between ankle segment and vertically oriented segments)
14 Fluid channel (vertically oriented)
15 Press tool (toe piece cut-out)
16 Press tool (ankle piece cut-out)
17 Toe island
18 Ankle island
19 Jersey material
**20*a*** Flat heat press
**20*b*** Press tool (female mold)

DETAILED DESCRIPTION OF INVENTION

The term "stockingfoot" refers to a fishing wader in which the bootie (or foot) of the wader fits inside of a fishing (or wading) boot. Stockingfoot waders offer versatility in that the wading boot can also act as a hiking boot when it is necessary to hike into a fishing spot, and they may be worn with different types of wading boots (felt sole, rubber sole, studded, etc.). The alternative to stockingfoot waders are bootfoot waders, in which the fishing boot is attached to the wader. Bootfoot waders are preferred for coldwater fishing and by surfcasters and saltwater anglers, where there is a greater chance of salt and grit getting into the boot than in ordinary fishing conditions; they are also considered to be warmer than stockingfoot waders. Stockingfoot waders, on the other hand, are considered by some to be easier to put on, easier to pack away, and generally preferred for all other fishing situations. Stockingfoot waders combined with a lack-up boot provide greater ankle support than a bootfoot wader and are typically better for miles of walking.

Stockingfoot waders may be made with neoprene, which is a non-breathable material, or with breathable materials such as GORE-TEX® fabric. Even on breathable waders, however, the bootie (or foot) of the wader is usually made with neoprene because of its durability, stretch, cushioning, and insulative properties. Although neoprene booties keep the wearer's feet warm and prevent water ingress, they also trap moisture due to perspiration. Excess perspiration in the bootie will rob the feet of precious heat. The present invention is designed to solve this problem by providing channels through which moisture is wicked up and out of the bootie—through the shaft of the bootie—and up into the breathable section of the wader. The present invention also provides added protection for the bootie seams and cushioning in the top of foot area to prevent wear. The invention also has been designed to add comfort to the user by providing more neoprene in certain areas. In addition, the added neoprene provides more insulation to keep the foot warmer. The present invention takes into consideration the relative thickness and durometer of various neoprene layers to achieve optimal performance.

The present invention incorporates both an internal set of channels that are built into the bootie starting at the ankle level and extending upward toward the top of the bootie and a configuration of channels that are formed by a raised section of neoprene that is situated on top of the outside of the front portion of the bootie (directly above the foot). The internal channels are specifically configured to move moisture vertically up the shaft of the bootie, which allows for greater airflow within the bootie. These channels work with the natural motion of the feet to push heavily moisture-laden air up through the shaft more effectively; once within the breathable portion of the wader (which begins mid-calf), this moisture will dissipate and leave the wader.

The second set of channels (on the outside of the bootie) is designed to create a separation between the bootie and the inside of the wading boot, thereby reducing wear and tear on the bootie, especially in the top of foot area. This raised neoprene area provides greater comfort at the top of the foot area when the laces of the wading boot (overlying the bootie) are tightened.

FIG. 1 is a perspective view of the present invention. As shown in this figure, the invention is a fishing wader 1 comprised of a body portion 2 and a bootie 3. The bootie 3 is attached to the body portion 2 with an adhesive. The novelty of the present invention relates to the construction of the bootie 3 and not to the body portion 2 or the method by which the bootie 3 is attached to the body portion 2.

Figure 2B:
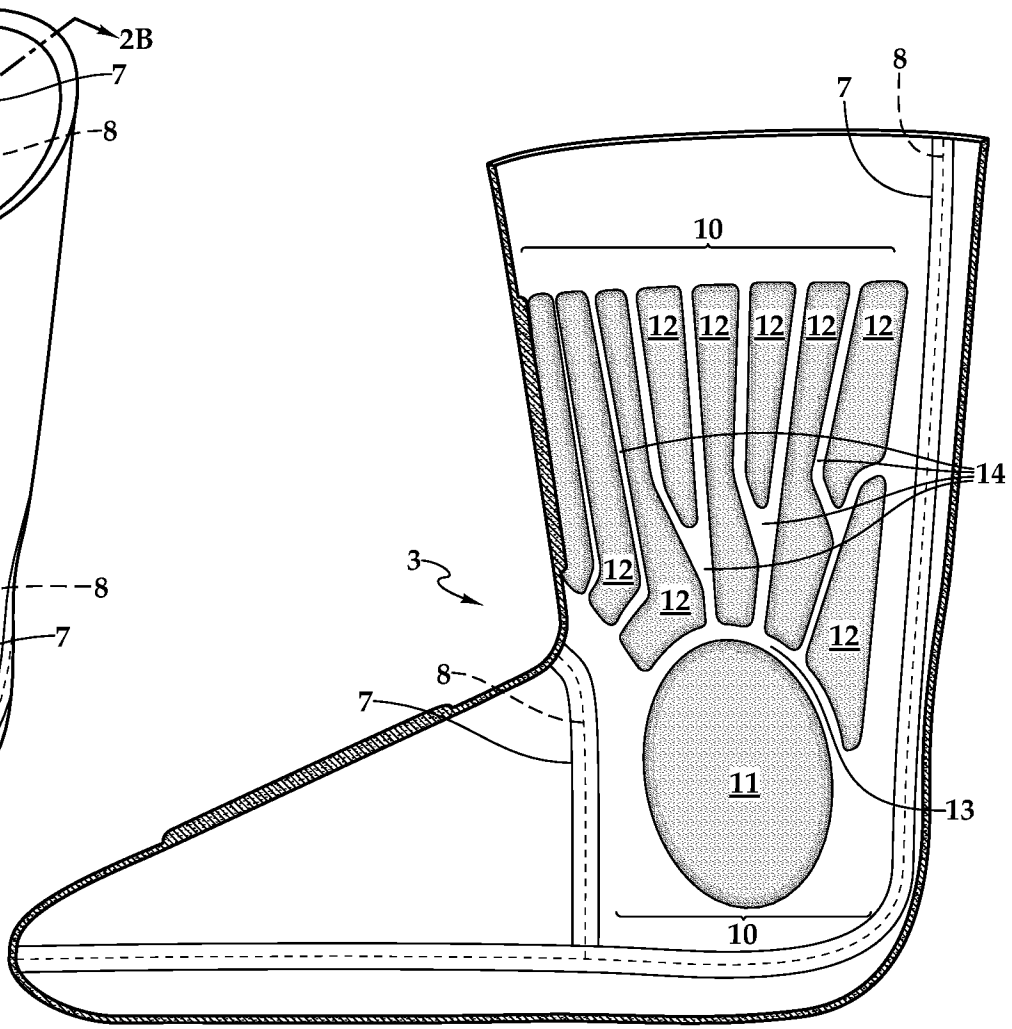
FIG. 2B is a longitudinal section view of the bootie shown in FIG. 2A.
Figure 2A:
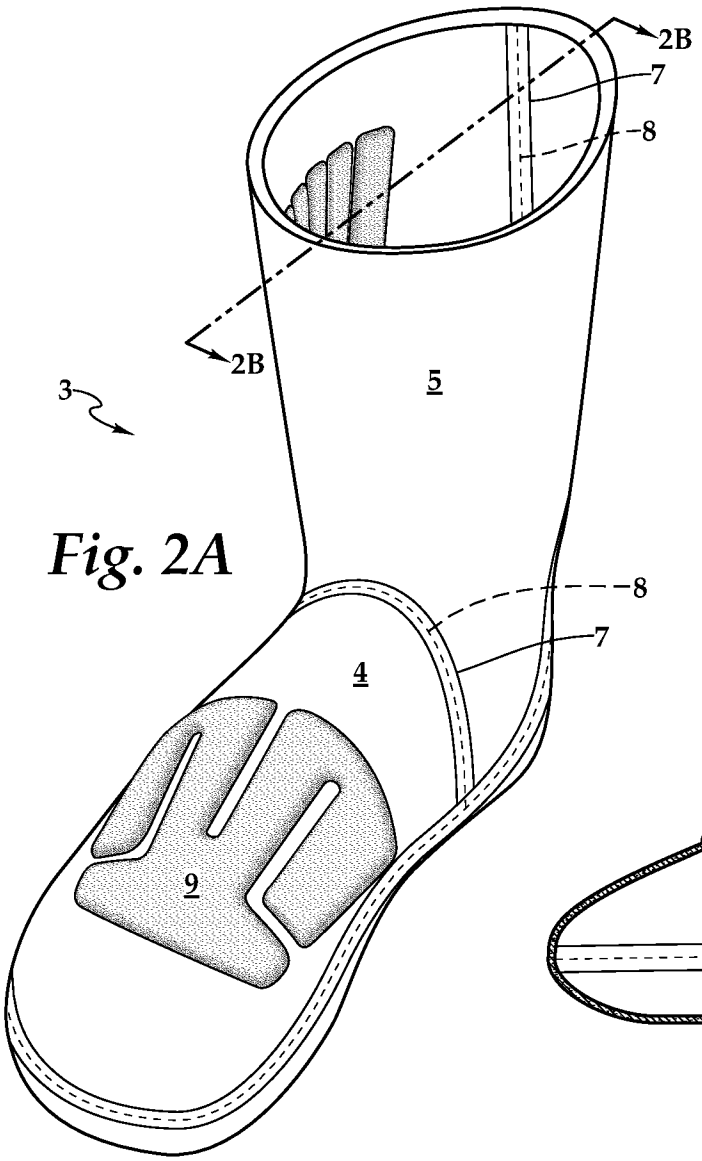
FIG. 2A is a perspective view of the bootie of the present invention.

FIG. 2A is a perspective view of the bootie of the present invention. As shown in this figure, the bootie 3 is comprised of three parts. The first part is the toe piece 4, the second part of the ankle piece 5, and the third part is the sole piece 6. These three pieces are all comprised of neoprene material, and they are all preferably of the same thickness (except for the raised neoprene areas). They are adhered (glued) together along their edges to form the bootie shape shown in FIG. 2A. Tape 7 suitable for this purpose is then applied along all of the joined edges, which form seams 8. In the figures, the seams 8 are shown with dotted lines. There are no stitched seams anywhere on the bootie. FIG. 2A also shows the raised neoprene area 9 on the outside of the toe piece 4. The raised neoprene area 9 may be formed in one of two ways, as described below.

FIG. 2B is a longitudinal section view of the bootie shown in FIG. 2A. As shown in this figure, the bootie 3 also comprises a raised neoprene area 10 on the inside of the ankle piece 5. This raised neoprene area 10 is also formed in one of two ways, as described below. The raised neoprene area 10 comprises an ankle segment 11 that is situated proximate the ankle of the wearer when the bootie 3 is worn. (Although the ankle segment 11 is shown here as being oval in shape, the present invention is not limited to an oval-shaped ankle segment 11.) The raised neoprene area 10 also comprises a plurality of vertically oriented segments 12, which are configured to form a fluid channel 13 around the top area of the ankle segment 11 (between the bottom ends of at least some of the vertically oriented segments 12 and the top edge of the ankle segment 11) and vertically oriented fluid channels 14 between the vertically oriented segments 12. Moisture from the foot area is wicked upward and into the breathable body portion 2 of the wader 1 when the wader is worn. The particular configuration of the vertically oriented segments 12, separated by vertically oriented fluid channels 14, provides greater flexibility (foldability) around the ankle area of the bootie. It also provides a better fit around the ankle area.

Figures 3A, 3B:
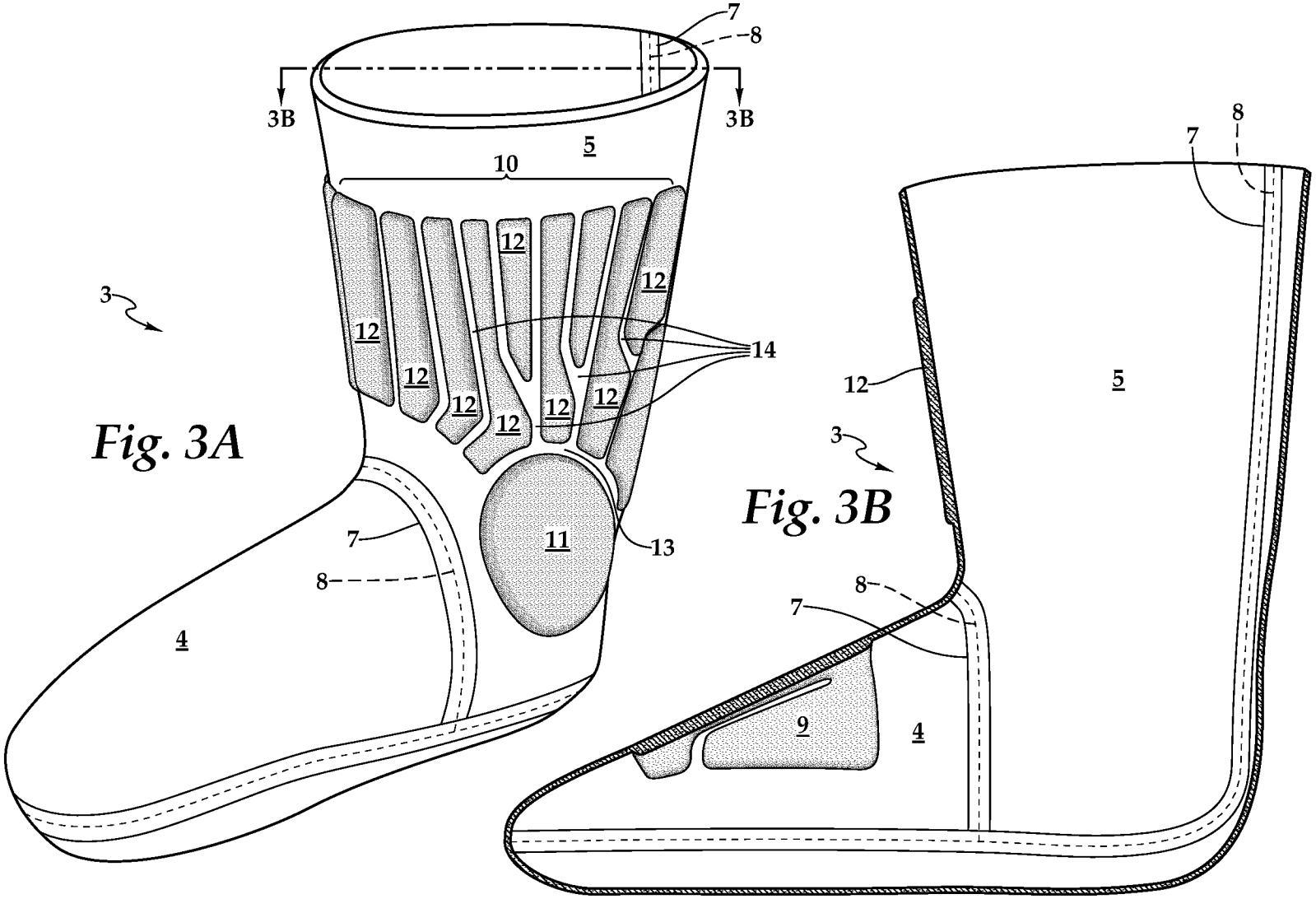
FIG. 3A is a perspective view of the bootie shown with the bootie turned inside-out.
FIG. 3B is a longitudinal section view of the bootie shown in FIG. 3A.

FIG. 3A is a perspective view of the bootie shown with the bootie turned inside-out. Each bootie comprises two ankle segments 11 (one on either side of the wearer's ankle). The vertically oriented segments 12 extend circumferentially all of the way around the inside of the bootie except for that portion of the bootie that is formed by the sole piece 6. Note also that the vertically oriented segments 12 are configured to form an arch over the midfoot (see also FIG. 5C). The bottom ends of the vertically oriented segments 12 are configured to form an arch over the ankle bone of the wearer. In a preferred embodiment, the entire inside surface of the bootie is coated with an antimicrobial chemical such as MICROBAN™ spray disinfectant to reduce odor.

FIG. 3B is a longitudinal section view of the bootie shown in FIG. 3A. As shown in this figure and FIG. 2B, the seams 8 are preferably taped 7 on both the inside and the outside of each seam 8. The sole piece 6 forms the sole of the bootie and a rear panel of the bootie that extends upward from the rear end of the sole to the top rear edge of the bootie. The toe piece 4 surrounds the top of the foot forward of the ankle (except for the sole). The ankle piece 5 surrounds the ankle area circumferentially except for the rear panel formed by the sole piece 6.

In one method of construction, the raised neoprene areas 9, 10 of the toe and ankle pieces 4, 5 are made by compressing a single layer of neoprene to form the raised neoprene areas. This method is illustrated in FIGS. 4A-4C.

Figure 4A:
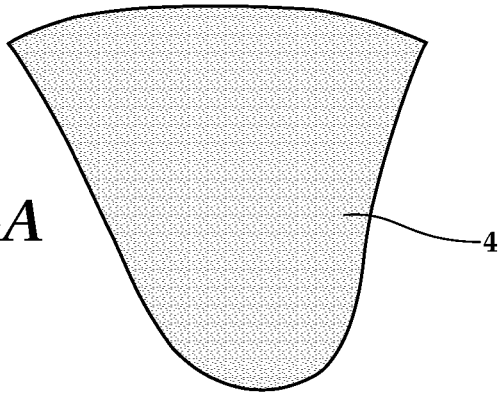
FIG. 4A is a pattern view of the toe piece before compression molding.

FIG. 4A is a pattern view of the toe piece before compression molding. The toe piece 4 is preferably comprised of a single layer of neoprene material with a layer of nylon jersey fabric adhered to one side of the layer of neoprene material and a layer of power stretch polyester jersey fabric adhered to the other side of the layer of neoprene material. (See FIGS. 9-11 below.) The toe piece 4 is preferably shaped as shown in FIG. 4A.

Figure 4B:
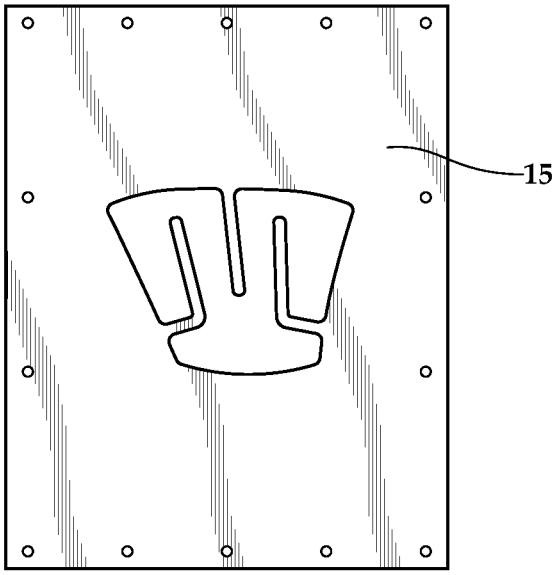
FIG. 4B is a pattern view of the press tool used to form the molded toe piece.

FIG. 4B is a pattern view of the press tool used to form the molded toe piece. The press tool 15 is a sheet of metal out of which is cut the pattern for the raised neoprene area 9.

Figure 4C:
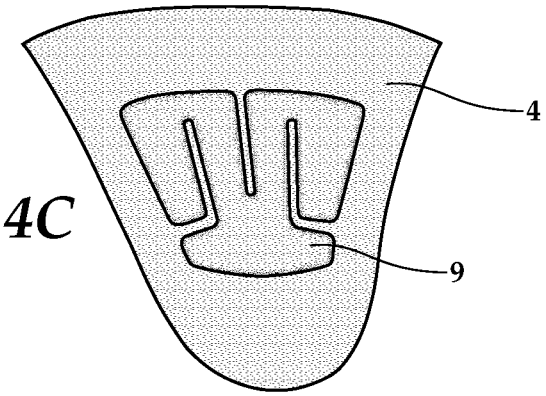
FIG. 4C is a pattern view of the toe piece after compression molding.
Figure 9:
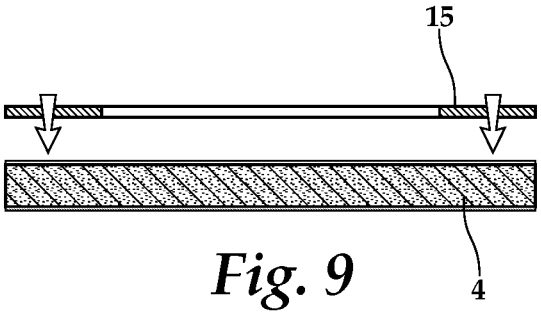
FIGS. 9-14 illustrate the compression molding method of manufacturing the present invention.
Figure 10:
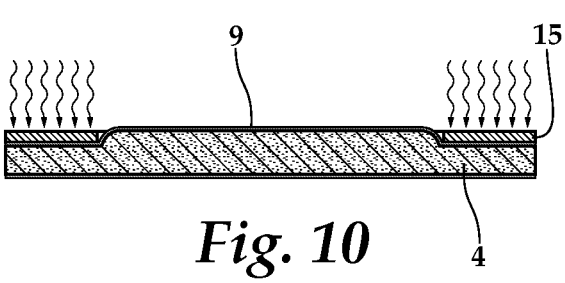
Figure 11:
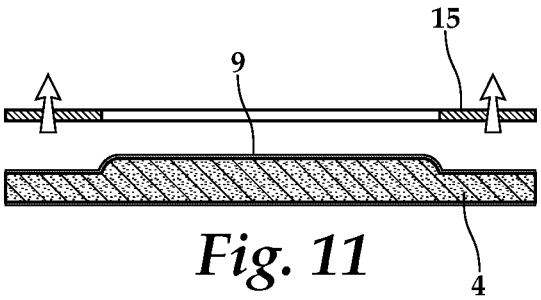

FIG. 4C is a pattern view of the toe piece after compression molding. The compression molding method is illustrated in FIGS. 9-11.

Figure 5A:
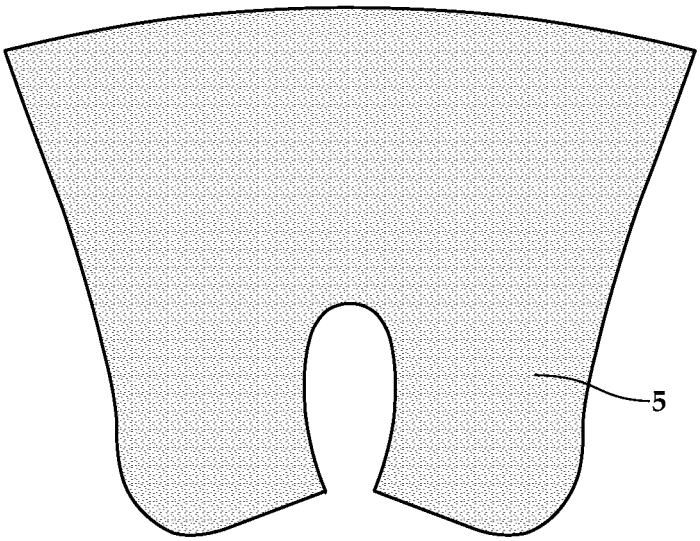
FIG. 5A is a pattern view of the ankle piece before compression molding.

FIG. 5A is a pattern view of the ankle piece before compression molding. The ankle piece 5 is preferably comprised of a single layer of neoprene material with a layer of nylon jersey fabric adhered to one side of the layer of neoprene material and a layer of power stretch polyester jersey fabric adhered to the other side of the layer of neoprene material. (See FIGS. 12-14 below.) The ankle piece 5 is preferably shaped as shown in FIG. 5A.

Figure 5C:
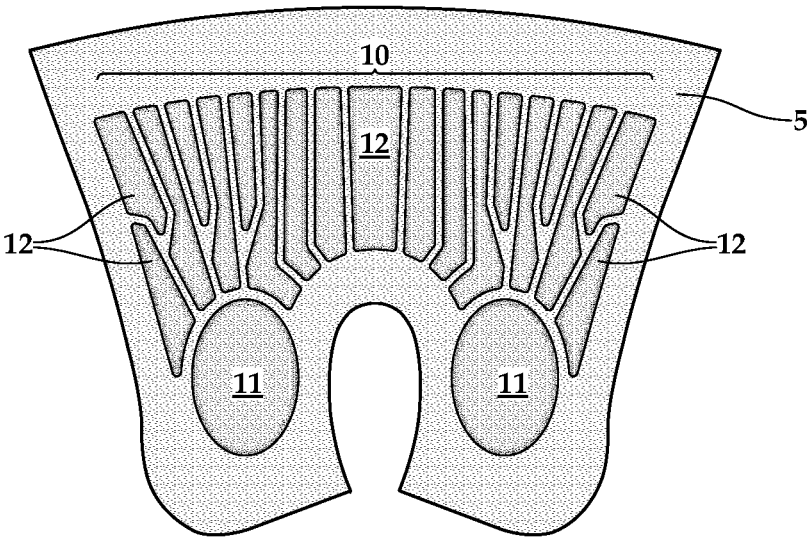
FIG. 5C is a pattern view of the ankle piece after compression molding.
Figure 5B:
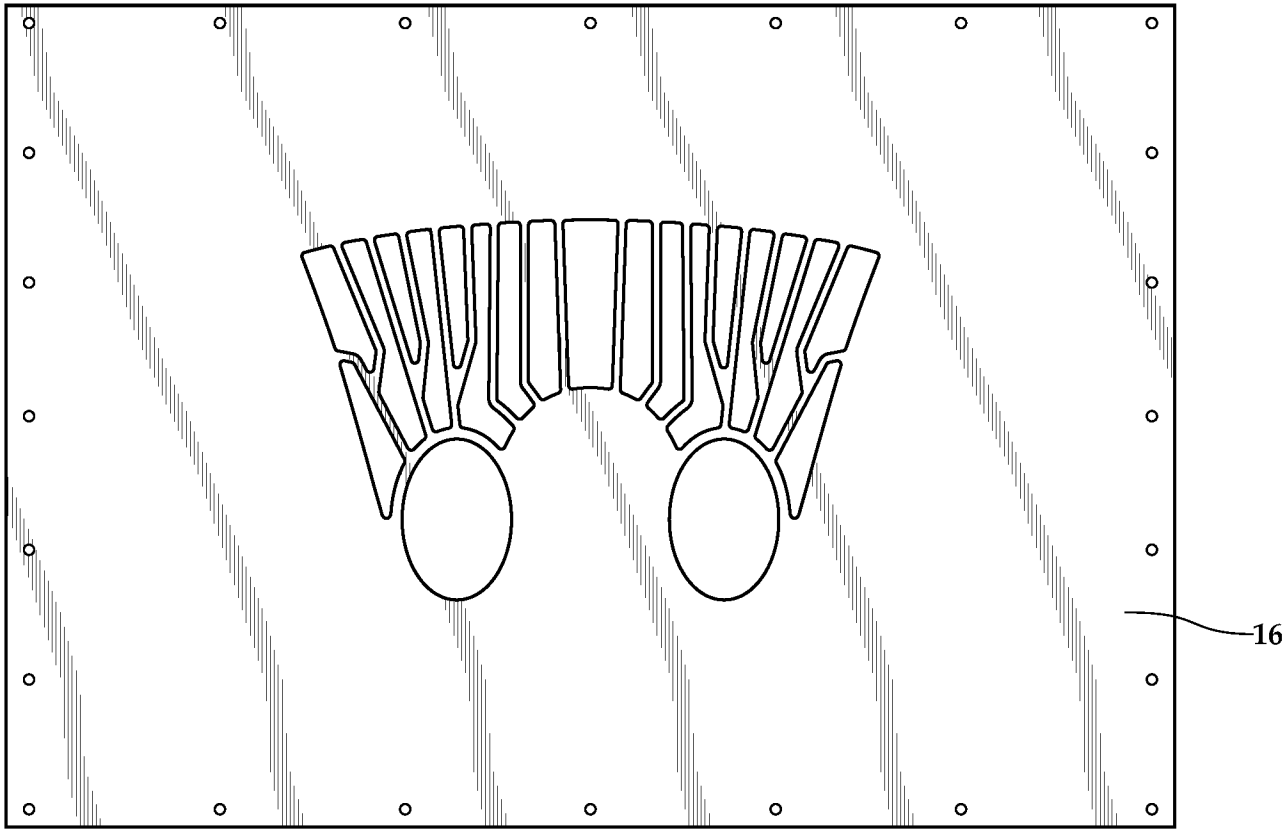
FIG. 5B is a pattern view of the press tool used to form the molded ankle piece.

FIG. 5B is a pattern view of the press tool used to form the molded ankle piece. The press tool 16 is a sheet of metal out of which is cut the pattern for the raised neoprene area 10.

Figure 12:
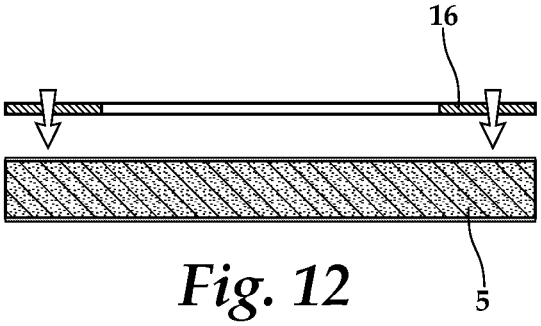
Figure 13:
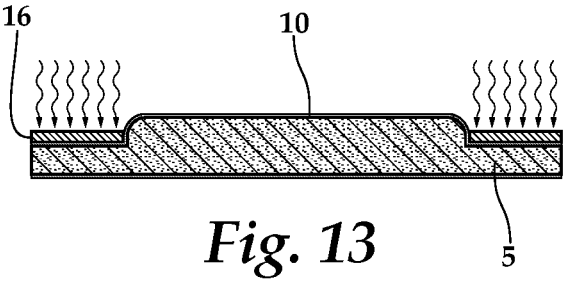
Figure 14:
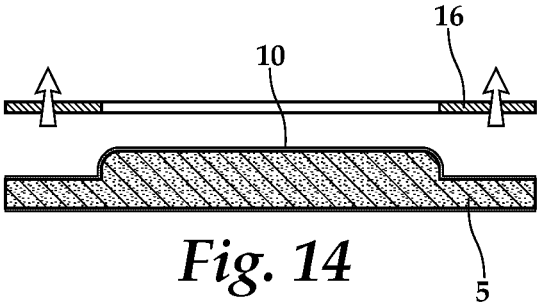

FIG. 5C is a pattern view of the ankle piece after compression molding. The compression molding method is illustrated in FIGS. 12-14.

Figure 6:
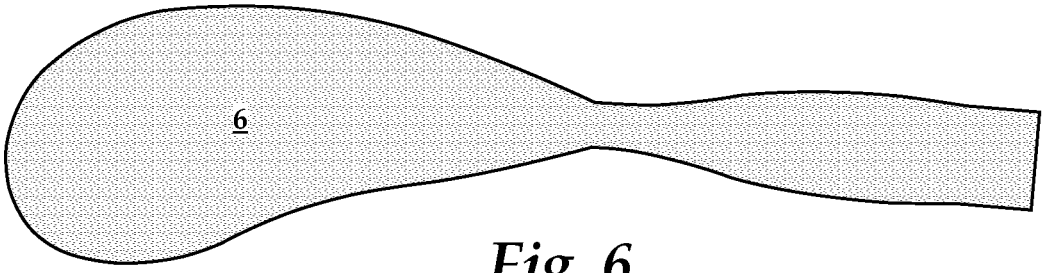
FIG. 6 is a pattern view of the sole piece.

FIG. 6 is a pattern view of the sole piece. This figure shows the part of the sole piece 6 that forms the sole of the bootie (left part of the figure) and the part of the sole piece 6 that forms the rear panel of the bootie (right part of the figure). The rear panel is situated proximate to the Achilles tendon of the foot when the bootie is worn.

Figure 7:
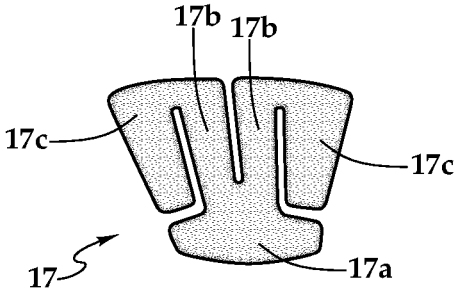
FIG. 7 is a pattern view of the toe island used in the stack-up manufacturing method.

FIG. 7 is a pattern view of the toe island used in the stack-up manufacturing method. In an alternate construction method, the raised neoprene area 9 on the toe piece 4 is formed by stacking a toe island 17 on top of an underlying layer of neoprene material. The toe island is a layer of neoprene material that has been cut into the shape of the raised neoprene area 9. In a preferred embodiment, the raised neoprene area 9 (in both the compression method and the stack-up method) comprises a lateral portion 17*a* that extends laterally across a front of the toe area, two extensions 17*b* extending rearwardly from a center part of the lateral portion, and two wings 17*c* that are parallel to and situated outside of each of the two rearwardly extending extensions 17*b*. In a preferred embodiment, the lateral portion 17*a*, rearwardly extending extensions 17*b* and wings 17*c* are all interconnected.

Figure 8:
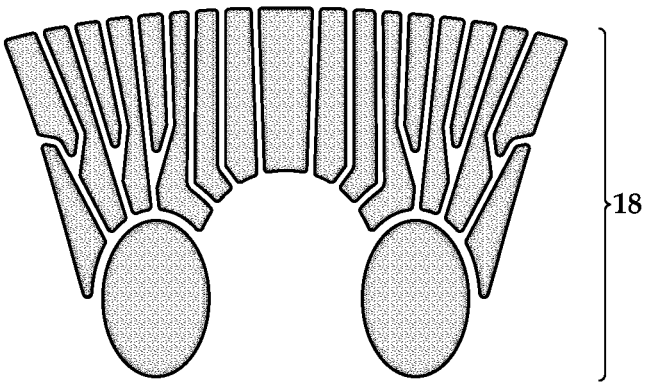
FIG. 8 is a pattern view of the ankle island used in the stack-up manufacturing method.

FIG. 8 is a pattern view of the ankle island used in the stack-up manufacturing method. The ankle island 18 forms the raised neoprene area 10 on the interior of the ankle piece 5. The particular configuration of the raised neoprene area 10 has been previously described.

FIGS. 9-14 illustrate the compression molding method of manufacturing the present invention. This method of construction is easier to perform and less costly than the stack-up method described in subsequent figures.

FIG. 9 is a section view of the toe piece of the bootie shown in relation to the press tool but before the tool comes into contact with the toe piece. As mentioned above, the neoprene layer consists of a layer of nylon jersey fabric adhered to the underside (bottom) of the neoprene material and a layer of power stretch polyester jersey fabric adhered to the top surface of the neoprene material. The thickness of the neoprene layer is preferably six (6) millimeters (mm) (including the jersey and polyester layers).

FIG. 10 is a section view of the toe piece of the bootie shown in relation to the press tool during the compression step. In this step, that part of the neoprene layer that forms the raised neoprene area 9 is not compressed, but the remaining part of the neoprene layer is compressed down to a thickness of four (4) mm by the press tool 15, which is applied for twenty (20) minutes at 33.6 pounds per square inch ("psi") and a temperature of 325 degrees Fahrenheit.

FIG. 11 is a section view of the toe piece of the bootie shown with the press tool being removed after compression. There is no cooling step with the compression method, as there is with the stack-up method.

FIG. 12 is a section view of the ankle piece of the bootie shown in relation to the press tool but before the tool comes into contact with the ankle piece. As with the toe piece, the neoprene layer consists of a layer of nylon jersey fabric adhered to the underside (bottom) of the neoprene material and a layer of power stretch polyester jersey fabric adhered to the top surface of the neoprene material. The thickness of the neoprene layer is preferably eight (8) mm (including the jersey and polyester layers).

FIG. 13 is a section view of the ankle piece of the bootie shown in relation to the press tool during the compression step. In this step, that part of the neoprene layer that forms the raised neoprene area 10 is not compressed, but the remaining part of the neoprene layer is compressed down to a thickness of four (4) mm by the press tool 16, which is applied for twenty (20) minutes at 33.6 psi and a temperature of 325 degrees Fahrenheit.

FIG. 14 is a section view of the ankle piece of the bootie shown with the press tool being removed after compression. There is no cooling step with the compression method, as there is with the stack-up method.

In a preferred embodiment, the neoprene layer that forms the toe piece has a durometer of eleven (11) using a GS-701N type C durometer tester prior to compression. The raised neoprene area 9, which is not compressed, retains this same durometer; the compressed area of the toe piece, however, has a durometer of twenty (20) using this same durometer test. In a preferred embodiment, the neoprene layer that forms the ankle piece has a durometer of eleven (11) using a GS-701N type C durometer tester prior to compression. The raised neoprene area 10, which is not compressed, retains this same durometer; the compressed area of the ankle piece, however, has a durometer of twenty-five (25) using this same durometer test.

FIGS. 15-26 illustrate the stack-up method of manufacturing the present invention. With this method, the islands 17, 18 are preferably first adhered to a flat sheet of neoprene (together with the overlying knit jersey fabric), and then the entire stack is die cut to form the toe and ankle pieces 4, 5.

Figure 15:
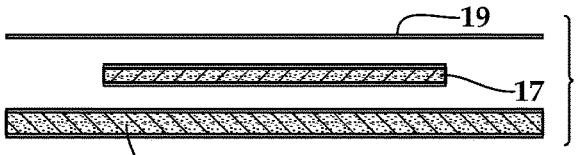
FIGS. 15-26 illustrate the stack-up method of manufacturing the present invention.
Figure 21:
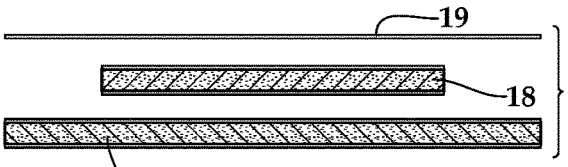

FIG. 15 is an exploded view of the toe piece of the bootie shown prior to assembly. This construction method begins with two layers of neoprene material. Each layer of neoprene material has a layer of nylon jersey fabric adhered to the underside (bottom) of the neoprene material and a layer of nylon jersey fabric adhered to the top surface of the neoprene material, as shown. In a preferred embodiment, the thickness of the top neoprene layer is two (2) mm, and the thickness of the bottom neoprene layer is three (3) mm (including the fabric layers in each case). Overlying both neoprene layers is a layer of knit jersey fabric 19 (78% nylon and 22% spandex). The purpose of the knit jersey fabric 19 is to further secure the toe island 17 on top of the underlying neoprene layer and to present a more finished look. When fully assembled, the toe island 17 is placed directly on top of the underlying neoprene layer, and the knit jersey fabric 19 is placed on top of both the toe island 17 and the underlying neoprene layer.

Figure 16:
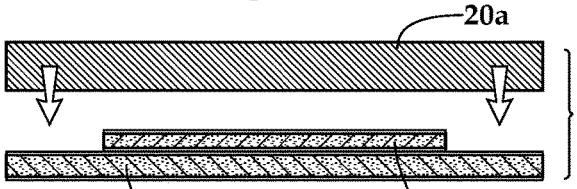
Figure 22:
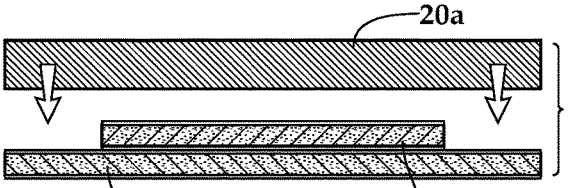
Figure 17:
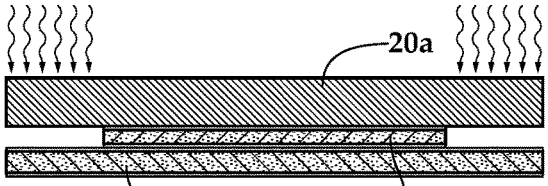
Figure 23:
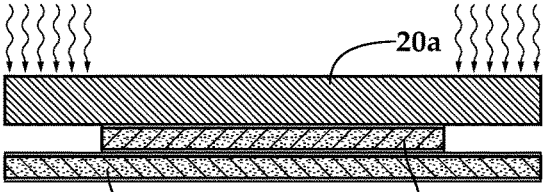

FIG. 16 is a section view of the flat heat press positioned above the neoprene island and the underlying neoprene layer. FIG. 17 is a section view of the toe piece of the bootie shown with the flat heat press in contact with the neoprene layers but with the knit layer omitted. In this step, the toe island 17 is bonded onto the underlying neoprene layer with a flat heat press 20*a*, which is applied for sixty (60) seconds at ten (10) psi and 260 degrees Fahrenheit. The flat heat press 20*a* activates an adhesive that is applied between the two neoprene layers. It does not appreciably compress either of the neoprene layers.

Figure 18:
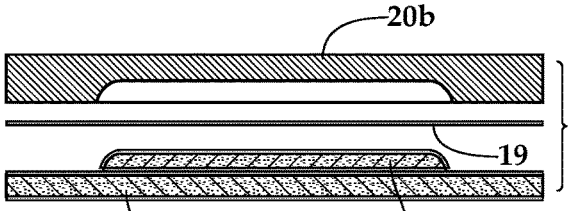
Figure 24:
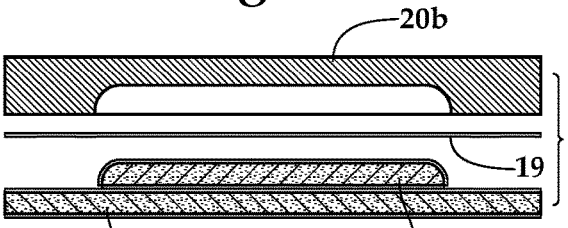
Figure 19:
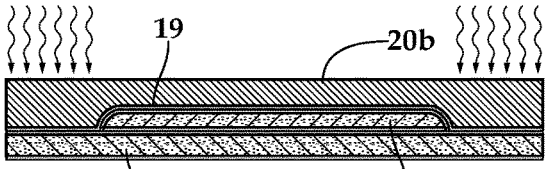
Figure 25:
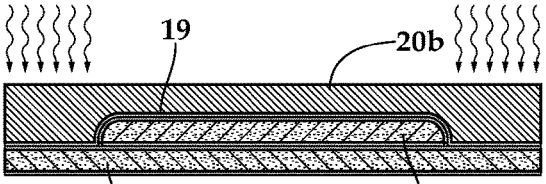

FIG. 18 is a section view of the toe piece of the bootie shown with the press tool (in the form of a female mold) positioned above the neoprene island and the underlying neoprene layer with the knit jersey fabric situated between the press tool and the neoprene layers. FIG. 19 is a section view of the toe piece of the bootie shown with the press tool in contact with the knit jersey layer. In this step, the knit jersey layer is placed over the top of the two neoprene layers (now bonded to each other), and a press tool 20*b* in form of a female mold 20*b* is applied for sixty (60) seconds at ten (10) psi and 260 degrees Fahrenheit. The press tool 20*b* activates an adhesive that is applied between the knit jersey layer and the top surface of the two stacked neoprene layers. Neither this nor the preceding step affects the durometer of either of the neoprene layers.

Figure 20:
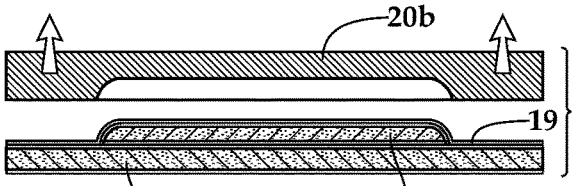
Figure 26:
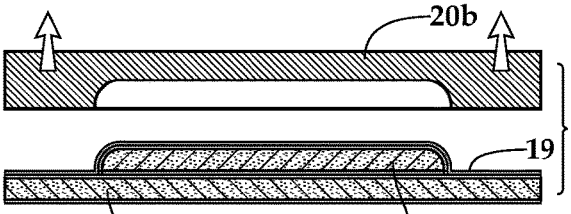

FIG. 20 is a section view of the toe piece of the bootie shown with the press tool being removed after the final adhesive step. After this step, the same press tool 20*b* is cooled to ambient temperature and applied to the neoprene stack-up for thirty seconds at 10 psi, which allows the adhesive to stabilize.

Applying the stack-up method, the ankle piece is made in the same manner as the toe piece, except that the neoprene layer for the ankle island is preferably three (3) mm thick rather than two (2) mm thick. Otherwise, the process is the same, as illustrated in FIGS. 21-26.

In a preferred embodiment, the two neoprene layers that form the toe and ankle pieces (that is, both the neoprene island and the underlying layer of neoprene material) each has a durometer of eleven (11) using a GS-701N type C durometer tester. The neoprene layer that forms the sole piece has a durometer of eighteen (18) using the same durometer test. Thus, the compression method results in the non-raised areas of the toe and ankle pieces having a higher durometer than with the stack-up method.

Although the preferred embodiment of the present invention has been shown and described, it will be apparent to those skilled in the art that many changes and modifications may be made without departing from the invention in its broader aspects. The appended claims are therefore intended to cover all such changes and modifications as fall within the true spirit and scope of the invention.

We claim:

1. A wader comprising a body portion and a bootie;

wherein the bootie is attached to the body portion:

wherein the bootie is comprised of a toe piece, an ankle piece, and a sole piece;

wherein the toe piece, the ankle piece, and the sole piece are adhered together to form the bootie;

wherein the toe piece has an outside surface, and the toe piece comprises a raised neoprene area on the outside surface;

wherein the ankle piece has an inside surface, and the ankle piece comprises a raised neoprene area on the inside surface;

wherein the toe piece, the ankle piece, and the sole piece are all comprised of a neoprene material;

wherein the raised neoprene area on the inside of the ankle piece comprises an ankle segment that is situated proximate the ankle of a wearer when the bootie is worn;

wherein the ankle segment comprises a top edge;

wherein the raised neoprene area on the inside of the ankle piece further comprises a plurality of vertically oriented neoprene segments with bottom ends;

wherein the plurality of vertically oriented neoprene segments are configured to form a fluid channel around a top area of the ankle segment between the bottom ends of at least some of the vertically oriented neoprene segments and the top edge of the ankle segment;

wherein the plurality of vertically oriented neoprene segments are configured to form vertically oriented fluid channels between the plurality of vertically oriented neoprene segments;

wherein the bootie has an inside with a circumference formed by the ankle piece and the sole piece;

wherein the plurality of vertically neoprene oriented segments extend circumferentially around an entire inside of the bootie except for that portion of the bootie that is formed by the sole piece;

wherein the plurality of vertically oriented neoprene segments are configured to form three separate downwardly curved arches, the three separate downwardly curved arches comprising a first downwardly curved arch that is situated over a midfoot of the wearer and second and third downwardly curved arches, each of which is configured to form an arch over an ankle bone of the wearer.

2. A wader comprising a body portion and a bootie;

wherein the bootie is attached to the body portion;

wherein the bootie is comprised of a toe piece, an ankle piece, and a sole piece;

wherein the toe piece, the ankle piece. and the sole piece are adhered together to form the bootie;

wherein the toe piece has an outside surface, and the toe piece comprises a raised neoprene area on the outside surface;

wherein the ankle piece has an inside surface, and the ankle piece comprises a raised neoprene area on the inside surface; and wherein the toe piece, the ankle piece, and the sole piece are all comprised of a neoprene material;

wherein the raised neoprene area on the outside surface of the toe piece comprises a lateral portion that extends laterally across a front of the toe area, two extensions extending rearwardly from a center part of the lateral portion, and two wings that are parallel to and situated outside of each of the two rearwardly extending extensions;

and wherein the lateral portion, rearwardly extending extensions and wings are all interconnected;

wherein the raised neoprene area on the inside of the ankle piece further comprises a plurality of vertically oriented neoprene segments;

wherein the plurality of vertically oriented neoprene segments are configured to form three separate downwardly curved arches, the three separate downwardly curved arches comprising a first downwardly curved arch that is situated over a midfoot of the wearer and second and third downwardly curved arches, each of which is configured to form an arch over an ankle bone of the wearer.

3. The wader of claim 2, wherein the bootie comprises an inside surface; and wherein an entire inside surface of the bootie is coated with an antimicrobial chemical.

4. The wader of claim 2, wherein the raised neoprene area on the outside of the toe piece is manufactured by stacking a neoprene island in a form of the raised neoprene area on top of an underlying layer of neoprene material, adhering the neoprene island to the underlying layer of neoprene material, and adhering a layer of knit jersey material to a top surface of the neoprene island and the underlying layer of neoprene material; and wherein the raised neoprene area on the inside of the ankle piece is manufactured by stacking a neoprene island in a form of the raised neoprene area on top of an underlying layer of neoprene material, adhering the neoprene island to the underlying layer of neoprene material, and adhering a layer of knit jersey material to a top surface of the neoprene island and a top surface of the underlying layer of neoprene material.

5. The wader of claim 4, wherein both the neoprene island and the underlying layer of neoprene material of the toe piece have a durometer of 11, both the neoprene island and the underlying layer of neoprene material of the ankle piece have a durometer of 11, and the sole piece has a durometer of 18 using a GS-701N type C durometer tester.

6. The wader of claim 4, wherein the neoprene island of the toe piece has a thickness of two millimeters and the underlying layer of neoprene material of the toe piece has a thickness of three millimeters; and wherein the neoprene island of the ankle piece has a thickness of three millimeters and the underlying layer of neoprene material of the ankle piece has a thickness of three millimeters.

* * * * *